US006070728A

United States Patent [19]

Overby et al.

[11] Patent Number: 6,070,728

[45] Date of Patent: Jun. 6, 2000

[54] FILTER BAG WITH VALVE

[75] Inventors: Douglas J. Overby; Jeffrey Scott Beer, both of Perkiomenville; Daniel R. Wigman, Harleysville, all of Pa.

[73] Assignee: Fres-co System USA, Inc., Telford, Pa.

[21] Appl. No.: 09/241,358

[22] Filed: Feb. 2, 1999

[51] Int. Cl.[7] ..... B65D 81/20

[52] U.S. Cl. ..... 206/524.8; 383/103; 137/854; 137/526

[58] Field of Search ..... 206/524.8; 383/103, 383/100; 137/246, 843, 852, 854, 855, 856, 526

[56] References Cited

U.S. PATENT DOCUMENTS

| | | | |
|---|---|---|---|
| 3,595,467 | 7/1971 | Goglio . | |
| 3,799,427 | 3/1974 | Goglio . | |
| 4,215,725 | 8/1980 | Callet et al. | 137/855 |
| 4,310,118 | 1/1982 | Kisida et al. | 338/103 |
| 4,576,285 | 3/1986 | Goglio . | |
| 4,705,174 | 11/1987 | Goglio . | |
| 4,890,637 | 1/1990 | Lamparter | 137/246 |
| 4,913,561 | 4/1990 | Beer . | |
| 4,953,708 | 9/1990 | Beer et al. . | |
| 5,526,843 | 6/1996 | Wolf et al. | 137/550 |

*Primary Examiner*—Paul T. Sewell
*Assistant Examiner*—Nhan T. Lam
*Attorney, Agent, or Firm*—Caesar, Rivise, Berstein, Cohen & Pokotilow, Ltd.

[57] ABSTRACT

A hermetic package for fine particulate material. The package is arranged to be filled and vacuumized to hold the fine particulate material therein and isolated from the ambient atmosphere. The package, which may be in the form of a pouch or a gussetted packages, is formed of a flexible material to have at least a front and a rear panel. At least one degassing valve is mounted in at least one of the panels to enable gas within the interior of the package to vent to the ambient atmosphere. A filter sheet, e.g., a spun-bonded plastic, such as Tyvek®, is secured to the interior of the package over the valve to prevent the fine particulate material within the package from entering into the valve and clogging it. The filter sheet may cover only a small portion of one of the panels of the package or may cover a major portion of that panel, or even cover substantially the entire interior of the package. The package includes a top portion forming a mouth, which is arranged to be opened, e.g., peeled or severed, in order to provide access to the particulate material within the interior of the package.

10 Claims, 3 Drawing Sheets

FILTER BAG WITH VALVE

BACKGROUND OF THE INVENTION

This invention relates generally to flexible packages, and more particularly to flexible packages for holding fine particulate materials under vacuum while allowing any gas within the package to escape to the ambient atmosphere via a degassing valve in a wall of the package.

Various types of flexible packages for holding particulate materials, e.g., ground or whole bean coffee, chemicals, etc., under vacuum have been disclosed in the patent literature and are commercially available today. Examples of such packages are found in the following U.S. Pat. No. 4,576,285 (Goglio), U.S. Pat. No. 4,705,174 (Goglio), U.S. Pat. No. 4,913,561 (Beer), and U.S. Pat. No. 4,953,708 (Beer, et al.).

As is known by those skilled in the art, major advantages of flexible packaging as compared to relatively rigid packaging, e.g., cartons, are that until the flexible package is filled it takes up very little volume, and after it is emptied of its contents it readily collapses. This reduces the bag volume to approximately that of the unfilled package. The former characteristic is a significant advantage insofar as storage is concerned, while the latter characteristic provides is a significant advantage from the standpoint of disposability. Both of these advantageous characteristics are due to the fact that flexible packages are not self-sustaining, i.e., they are formed of sheet materials which cannot sustain the shape of the package if not filled.

One common type of flexible package for holding goods under vacuum until the package is opened is the so-called "gussetted" package or bag. Typically such a package is formed from a web of flexible stock material, e.g., polyethylene, polyester, polypropylene, metal foil, and combinations thereof in single or multiple plies, into a tubular body, having a face panel, a back panel, and a pair of gussetted sides. Each gussetted side is formed by a pair of gusset sections and a central fold edge interposed between a pair of outer fold edges. The lower end of the bag is commonly permanently sealed, e.g., heat sealed, along a line extending transversely across the width of the bag close to its bottom edge. The top of the bag is commonly sealed transversely across the entire width of the bag in a number of ways to maintain the contents under vacuum until the bag is opened. Such action is frequently accomplished via a readily openable mouth, which when opened provides access to the contents of the bag. For example, in one prior art package the top seal is made peelable by modifying the sealant layer with a peelable coating or incompatible additive. Thus, when the seal is peeled apart the unsealed portions form an open mouth through which the contents of the package may be removed. Another approach to providing an opening or mouth for a flexible package is that of the heretofore identified U.S. Pat. No. 4,705,174 (Goglio). That package includes a peel strip applied to the inner surface of the package below the top edges. The strip provides an airtight interfacial seal which can be readily peeled apart to provide access to the interior of the package.

For many applications of peelably openable flexible packaging it is desirable to be able to reclose the package after its mouth has been peeled opened in order to retain the remaining contents in the package so that they do not spill out, and/or that odors do not emanate from the package when the contents are odoriforous, and/or that the contents be somewhat isolated from the ambient atmosphere. Reclosure of such packages has been accomplished in several ways. One way is to fold over the top portion of the package contiguous with the peeled-open mouth to form a flap and to then apply a small strip of adhesive tape or a small preprinted adhesive label onto a portion of the flap and a portion of the contiguous package to hold the flap in place.

Other types of flexible package are also disclosed in the patent literature and are commercially available. One such type of flexible package is commonly constructed in the form of a "pouch" or "sack" having a front panel and a rear panel secured together along their marginal edges, without the use of side gussets. This type of package has the shape of a somewhat flattened pillow. These pillow or pouch type packages typically include a mouth portion which is arranged to be opened to provide access to the contents of the package. The mouth may be constructed so that the front and rear panels forming the package are peelably connected to each other to enable them to be grasped to be peeled apart to open the mouth of the package. Alternatively, the mouth of the package can be made severable, such that it can be cut or torn to provide access to the interior of the package.

In order to vent gases out of a hermetically sealed flexible package (whether of the gussetted or pouch type) containing a product, such as ground coffee, etc., it is a common practice to include a one-way "degassing" valve in a wall of the package to allow gas produced by the product or air entrapped in the package to vent to the ambient atmosphere while precluding the ingress of air into the package. Some of the degassing valves used also include a filter disk made out of paper or some other filter material to prevent the ingress of particles or debris into the valve, since such action could clog up the valve. Notwithstanding, the existence of degassing valves having internal filtering means, e.g., filter disks, it has been discovered that in hermetically sealed packages for very fine particulate materials, the one-way degassing valve sometime becomes partially or totally clogged with those particles. This occurrence may cause the valve to shut down, e.g., the outlet port of the valve become fully occluded or blocked, to prevent gas within the package from exiting to the ambient atmosphere, or may cause the flexible valve member (disk) to lift off of the valve seat, whereupon the ambient atmosphere may gain ingress into the package through the now open valve. In either case, the effectiveness of the valve is compromised, if not nullified.

The present invention successfully overcomes this disadvantage of the prior art hermetically sealed packages by including in the wall of the package a panel of filter material which may be considered as a "pre-filter" to the valve.

Prior to the present invention, it was known to produce flexible packages where the entire structure of the package, i.e., all of its walls, were made up of a filtering material, e.g., spun-bonded plastic, such as that sold under the registered trademark "TYVEK" by E.I. du Pont de Nemours & Co., Wilmington, Del., apparently to create a "breathable" package. It is also known to construct flexible packages of a plastic material including either a "header" strip of filtering material at the end of the package or an isolated or circular strip of filtering material, e.g., TYVEK® to function to create a "breathable" package. The disadvantages to these two known products are that they do not provide complete or absolute barrier properties and therefore cannot serve as effective hermetically sealed packages.

SUMMARY OF THE INVENTION

A package having an interior for holding a fine particulate material therein. The package has at least one wall panel, a degassing valve mounted on the wall panel, and a filter panel. The valve has an inner portion in communication with the interior of the package and an outer portion in communication with the exterior of the package to enable gas within the package to vent to the ambient atmosphere outside the package. The package is formed of a flexible sheet material suitable for being hermetically sealed so that the fine particulate material is enclosed within the interior of the package and isolated from the ambient atmosphere. The filter panel is formed of a flat flexible sheet and is secured to at least one wall panel of the package over the interior portion of the valve to prevent the fine particulate material from entering the valve (which action could clog the valve rendering it inoperative).

DETAILED DESCRIPTION OF THE PREFERRED EMBODIMENT

Figure 1:
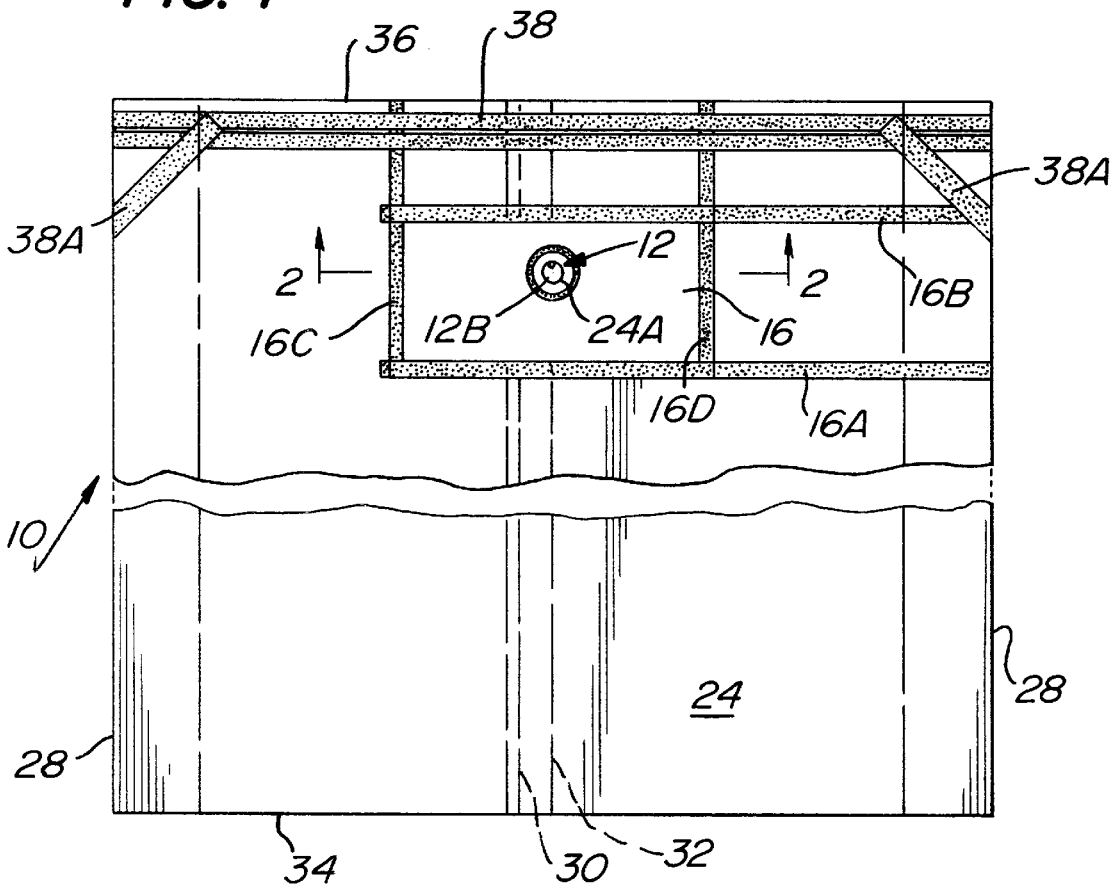
FIG. 1 is a plan view of one embodiment of a package constructed in accordance with this invention.
Figure 2:
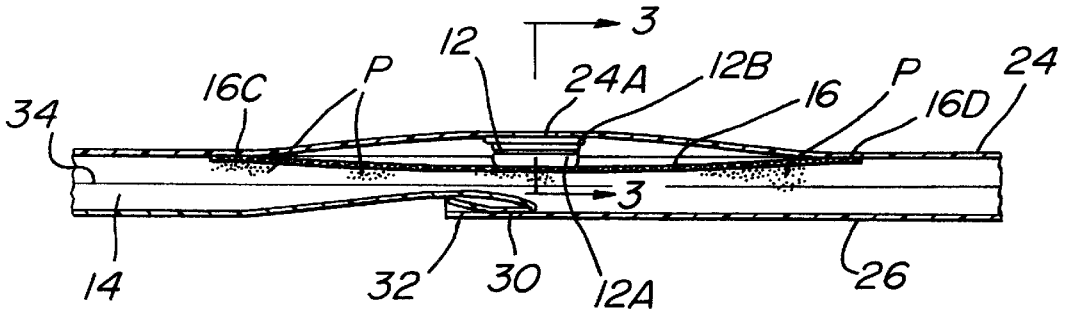
FIG. 2 is an enlarged sectional view taken along line 2—2 of FIG. 1.

Referring now to the various figures of the drawing wherein like reference characters refer to like parts, there is shown at 10 in FIGS. 1 and 2 one embodiment of a flexible package or bag 10 of this invention. The package is constructed to allow the venting of gas via a one-way degassing valve 12 from the interior 14 of the package to the ambient atmosphere, while precluding ingress of the ambient atmosphere into the package. The package is particularly suitable for holding a powdery or very fine granular product P under hermetically sealed conditions. To that end, the valve 12 serves to prevent the ingress of air into the package while enabling gas(es) within the package to vent to the ambient atmosphere. The valve includes an inner portion 12A (FIG. 3) which is in communication with the interior 14 of the package and an outer portion 12B which is in communication with the exterior of the package, i.e., the ambient atmosphere. In order to ensure that the valve 12 remains operative, e.g., does not become clogged by the fine particulate material P within the package, the package includes a filter panel 16 (to be described in detail later) in at least one of its walls and disposed over the valve 12. In particular, as will be described in greater detail below the filter panel 16 is heat sealed or otherwise adhered around its perimeter to the inside surface of the sheet material forming at least one wall of the package and so that a portion of the filter panel overlies the inner portion 12A of the valve 12. The details of the construction and operation of the valve 12 will also be discussed in detail below.

The package or bag 10 will first be described through disclosure of one possible configuration. This description is not meant to limit the size, shape, configuration or additional features of the package or product type of the subject invention. Nor is it meant to limit the type or number of valve(s) used or the size, shape or exact type or grade of filter material used for the filter panel. Moreover, the walls of the package may be formed of a variety of plastic, paper and/or foil materials, as required by the product to be packaged, and may be gussetted, or non-gussetted.

As shown in FIGS. 1 and 2, the exemplary body of the package or bag 10 is formed from a single sheet of plastic material folded into a tube to form a front panel 24 and a rear panel 26 interconnected by a pair of side gussets or panels 28. A permanent seal line extends along the edges of the sheet and is centered on the back panel 26. The seal line extends the full length of the tube parallel to the side gussets to form a fin 32.

The valve 12 is mounted, e.g., heat sealed, to the front panel 24 between the front panel and the back panel (as will be described later) so that the outer portion 12B of the valve is in communication with the ambient atmosphere via an opening or hole 24A in the front panel 24.

The filter panel 16 comprises a strip or sheet of filter material which is large enough to fully cover the inner portion 12A of the valve 12 and contiguous portions of the front panel of the package. The filter panel is heat sealed or otherwise adhered around its periphery to the front panel without the perimeter or preiphery of the sheet contacting the valve 12. Thus the interior portion 12A of the valve 12 is fully covered by the filter panel.

As shown in FIG. 1, one end package, e.g., the bottom 34, is sealed across the full width of the package. The other end e.g., upper end 36, of the package is initially open. It is through this open end that the bag is filled and then vacuumized and heated sealed or welded along a seal line 38. The seal line 38 extends across the full width of the package and includes angled portions 38A also extending across the gussets 28. The seal line 38 may be made peelable utilizing any conventional technique so that it can be pulled apart to form an open mouth (not shown) providing access to the interior 14 of the package. Access to the interior of the package may be provided in other ways as well, e.g., by cutting or otherwise severing the package below the seal line 38.

Figure 3:
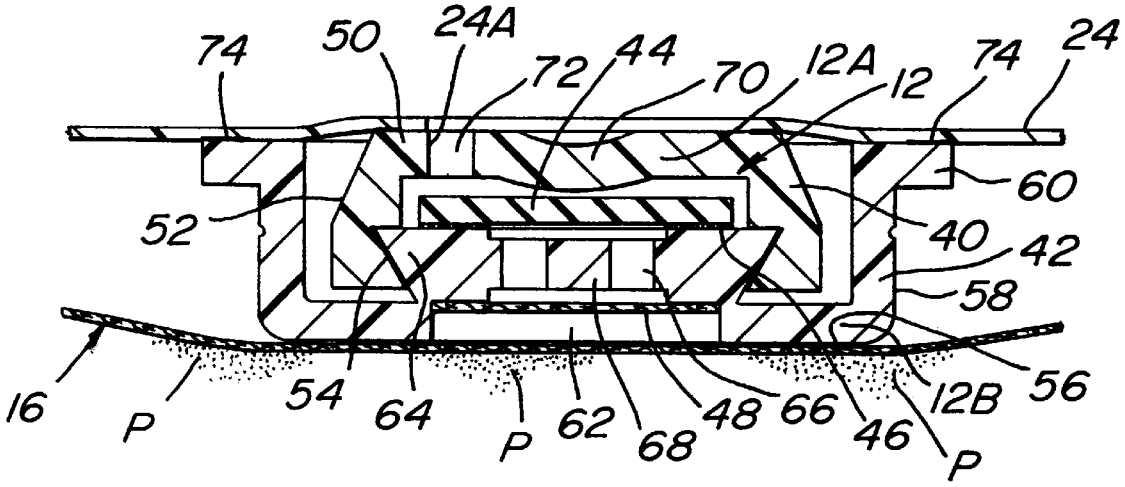
FIG. 3 is an enlarged sectional view taken along line 3—3 of FIG. 2 and showing the degassing valve of the package in its normally closed condition precluding the ingress of ambient air into the package.
Figure 4:
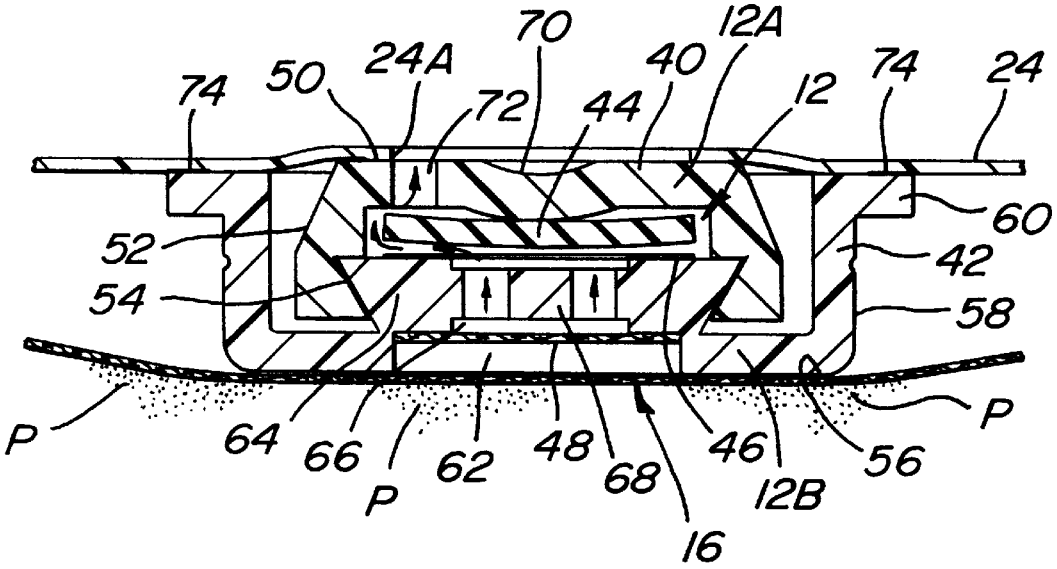
FIG. 4 is a view similar to FIG. 3, but showing the valve venting gas out of the package to the ambient atmosphere.

Referring now to FIGS. 3 and 4, the valve 12 can be seen to basically comprise a cap member 40 forming the outer portion 12A of the valve, a plate or base member 42 forming the inner portion 12B of the valve, an elastomeric, e.g., rubber, disk 44, a thin layer of oil, e.g., silicone oil, 46, and a filter disk 48. Preferably the valve is constructed somewhat like those of U.S. Pat. No. 3,595,467 (Goglio) and U.S. Pat. No. 3,799,427 (Goglio), whose disclosures are incorporated by reference herein.

The cap member 40 is a generally cylindrical member having a planar circular top wall 50 and a circular slightly conical side wall 52 terminating at its bottom in an under-cut annular groove 54. The base member 42 is a generally cup-shaped member having a planar circular bottom wall 56 and a circular sidewall 58 terminating at its top in an annular flange 60. The bottom wall 56 includes a central opening or hole 62 having an annular flange 64 extending thereabout and projecting up from the interior surface of the bottom wall 56. The flange 64 is under-cut on its exterior surface to be received in and mate with the under-cut groove 54 in the cap member 40. The top surface of the annular flange 64 is planar and forms the "valve seat." A central hole 66 is provided in the flange 64 and is smaller than the hole 62 to form a ledge on which the filter disk 48 is disposed and secured, e.g., glued or heat sealed in place. A pair of cruciate arms 68 are located within the hole 66 to help support the filter disk.

The top wall 50 of the cap member 40 includes a dimple 70 extending slightly downward to serve as a "disk contact point" to space and hold the disk member 44 on the valve seat. The top wall 50 also includes a small vent hole 72 immediately adjacent the dimple 70. It is through this vent hole 72 that gas from the interior 14 of the package exits the valve 12 to the ambient atmosphere. The top surface of the cap 40 abuts the inner surface of the front panel 24, with the vent hole 72 in the cap being located within the bounds of the hole 24A in the front panel 24 to communicate with the ambient atmosphere. The flange 60 of the base member is also welded about its periphery 74 to the inner surface of the front panel, thereby securely holding the valve in place.

The disk 44 member is a planar circular member disposed on the valve seat disposed over the central hole 66 in the base member. A thin layer of the silicone oil 46 is interposed between the disk 44 and the valve seat. The cap member 40 is arranged to be snap fit to the base member 42 to form a hollow interior chamber, with the disk member 44 and oil layer 46 being disposed therein.

In accordance with a preferred embodiment of this invention the cap member 40 and base member 42 are injection molded of polyethylene. The disk member 46 is stamped from a sheet of polyisobutylene rubber. The filter 48 comprises a circular disk or sheet of non-woven, heat-sealable filter paper.

The elastic nature of the rubber disk 44 enables it to flex during operation of the valve. In particular, when the pressure within the package exceeds the pressure outside of the package the disk flexes off of the valve seat to create a gap through which gas from the interior of the package can pass to the ambient atmosphere, such as shown by the arrows in FIG. 4. The elastic nature of the rubber disk 46 also serves to effect the automatic reclosure of the valve when the pressure within the package drops to that outside the package, whereupon the disk assumes its unflexed, flat configuration in engagement with the valve seat, such as shown in FIG. 3. The viscous nature of the silicone oil serves to create a seal between the valve seat of the base member and the rubber disk which is impermeable to atmospheric gasses (e.g. oxygen), moisture, and odors.

The filter member, e.g., paper disk 48, is normally used in the valve 12 and in such use is disposed so that it covers the orifice or hole in the base member in order to protect the valve mechanism from being contaminated by particles of the product P in the package. However, with the subject invention since the wall of the package includes the heretofore identified filter panel 16, which is arranged to prevent the passage of very fine particles therethrough and into the valve, the use of a paper filter disk 48 in the valve 12 may be eliminated.

If desired, the degassing valve used in the package of this invention may be constructed in accordance with the teachings of copending U.S. patent application Ser. No. 08/826,700 filed on Apr. 7, 1997 and U.S. patent application Ser. No. 09/134,301, filed on Aug. 14,1998, both entitled Pressure Vacuum Release Hermetic Valve For Flexible Package, which are assigned to the same assignee as this invention, the entire disclosures of which are incorporated by reference herein. The valves of those applications are "two-way" valves particularly useful for packages wherein the use of a conventional one-way degassing valve, like those discussed above, may result in the creation of an undesirable pebbly or unsmooth appearance of the walls of the package when the package is filled and evacuated.

For most industrial applications the smooth appearance of the packaging is typically not a factor. If however, the smooth appearance of the package's walls is desired the twoway valve of the aforementioned patent applications may be used in place of a one-way degassing valve. The two-way valves of those applications are similar to the one-way degassing valves, except for the inclusion of one or more slits or apertures in the rubber disk member 44. The inclusion of such slits or apertures results in a pressure equalizing valve which is arranged to operate in a first mode of operation wherein any gasses within the package are allowed to vent to the exterior of the package, while the ambient atmosphere is precluded from entering into the interior of the package. The valve also operates in a second, transitory, mode wherein it allows a small amount of the ambient atmosphere to gain ingress through the slits in the disk into the interior of the package so that the package's walls provide a smooth visual appearance. The valve then enters into its third mode of operation wherein it isolates the interior of the package from the exterior, e.g., further ingress of air through the slots is precluded.

As explained in the foregoing applications two mechanisms are relied upon for the two-way pressure equalizing valve to operate. In particular, the elastic nature of the rubber disk enables the area portions of the disk between adjacent or contiguous slits to flex independently of other portions of disk between or adjacent other contiguous slits. Moreover, when the rubber disk is flexed during operation of the valve, a gap is created at the interface of the slits and through which outside air can pass. The elastic nature of the rubber disk also serves to effect the automatic reclosure of the slits and to keep the slits closed and impermeable to oxygen, moisture, and odors when the disk is unflexed and flat. The viscous nature of the silicone oil serves to create a seal between the valve seat of the base member and the rubber disk which is impermeable to atmospheric gasses (e.g. oxygen), moisture, and odors.

As mentioned above the filter bag 10 of the present invention overcomes the disadvantages of the prior art as it prevents valve clogging by the product contained in the bag, by use of a breathable filter panel forming at least a portion of the inner surface of the bag overlying the valve. The use of a valve for gas evacuation maintains the barrier properties and hermetic integrity of the package.

In the embodiment shown in FIGS. 1–4, the filter panel 16 basically comprises a rectangular strip or web of any suitable filtering material. One particular suitable material is the heretofore identified TYVEK® material. The panel 16A is fixedly secured about its entire periphery to the inner surface of the front panel 24 via plural heat seal lines 16A, 16B, 16C and 16D. As can be seen in FIG. 1 the heat seal line 16A and 16B extend to one gussetted marginal edge of the package, whereas the line 16C and 16D extend to the top edge of the package. This sealing arrangement is chosen to expedite making the package by mechanized machinery. Thus, it should be appreciated by those skilled in the art that the heat seal lines need not extend to the marginal edges of the package, so long as they extend fully about the periphery of the filter panel 16. With the filter panel 16 in place, its inner surface is disposed over the inner portion 12A of the valve 12, as shown in FIGS. 2–4. Thus, the very fine particulate material P within the interior 14 of the package is precluded from gaining ingress into the interior of the valve. By virtue of the fact that the filter panel 16 is of considerably larger cross sectional area than the cross-section of the opening in the valve substantial gas flow is permitted through the filter panel in the furtherance of facilitating proper operation of the valve to allow such gases to exit therefrom as shown in FIG. 4.

Figure 5:
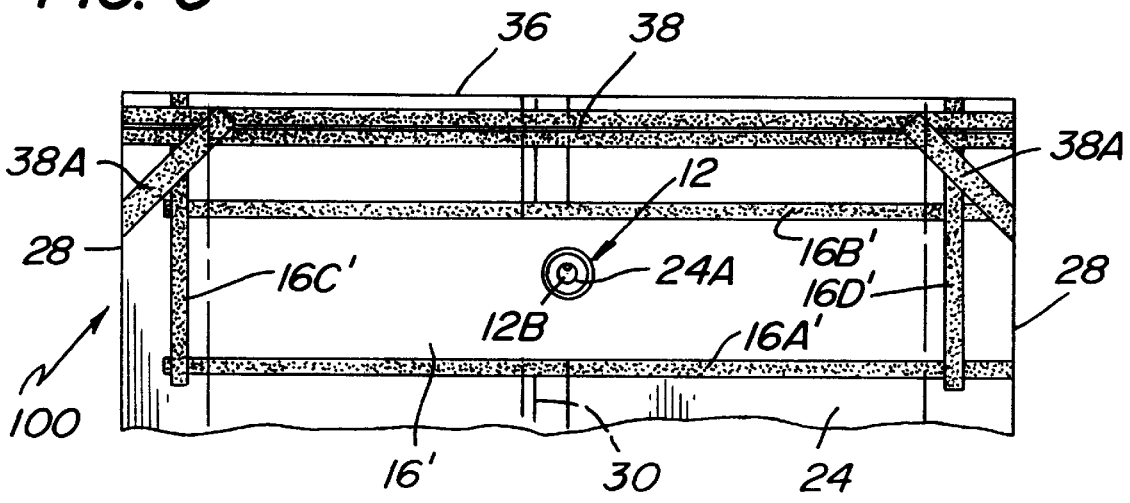
FIG. 5 is a view similar to FIG. 1, but showing the top portion of an alternative embodiment of a package constructed in accordance with this invention.

Various alternative embodiments to the present invention are possible. For example, in FIG. 5, there is shown an alternative embodiment 100 of the package of this invention. The package 100 is identical in construction to package 10, except that the filter panel extends for approximately the full width of the front panel 24. In the interest of brevity the same reference numbers will be given for the like components of the packages 10 and 100. Moreover, the function and operation of those components will also not be reiterated. Thus, it can be seen in FIG. 5 that the filter panel 16' is comprised of a rectangular strip of breathable material which extends transversely across virtually the entire width of the front panel of the bag. The filter panel is fixed to the front panel of the package in the same fashion as the filter panel 16 shown in FIGS. 1–4, by heat sealing along its perimeter via heat seal lines 16A', 16B', 16C' and 16D'. Since the filter panel 16' is made of a breathable material, by increasing its size over the panel 16 of the embodiment of FIG. 1, one thus increases the filter panel's surface area, which concomitantly results in a greater amount of gas flow through it from the interior 14 of the package.

As should be appreciated by those skilled in the art, one can vary the dimensions and location of the filter panel, as desired, depending upon the circumstances of use and the type and quantity of product contained within the package and the number and location of valves used.

Figure 6:
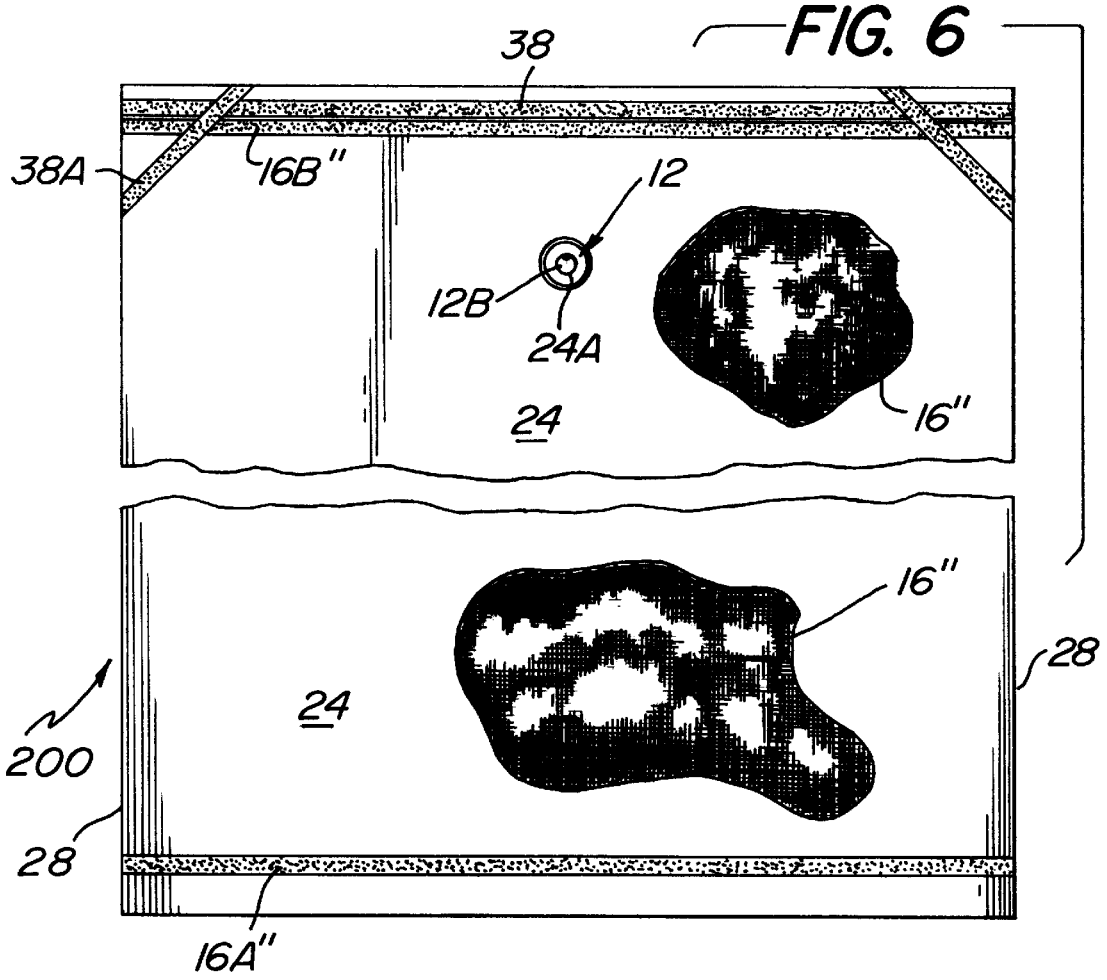
FIG. 6 is a view similar to FIG. 1, but showing yet another alternative embodiment of a package constructed in accordance with this invention.

Another embodiment of the present invention is shown in FIG. 6, where the package 200 is arranged for use with especially fine or powdery products, e.g., precipitated silicone dioxide. In that embodiment, the package 200 is identical to package 10 and 100 except that the filter panel 16" covers the entire interior 14 of the package, i.e., the filter panel 16" comprises a sheet covering each of the front, rear and gusseted side wall panels of the package. This embodiment 200 may be formed by securing the filter panel 16" along transverse heat seal lines 16A" and 16B" about the entire inner periphery of the tube being formed into package 200. In addition a longitudinal seal line (not shown) is used to seal the longitudinal marginal edges of the filter sheet to each other. The package 200 functions the same way as earlier described but now has maximum surface area to filter the product before gas is evacuated from the interior of the package, while still permitting the package to properly "breathe," i.e., enable gas within the package to pass through the filter panel into the degassing valve for egress to the ambient atmosphere.

It should be noted that any of the packages of this invention may incorporate a folded flap (not shown) at the end portion forming the package's mouth to protect a peelable seal (if the package includes one) and/or to form a carrying handle.

Moreover, it should be apparent that packages of the present invention need not be made gussetted, e.g., they can be in the form of a pouch or sack having a front panel and a rear panel which are connected to each other. In addition, in accordance with the present invention, more than one valve (and thus more than one filter panel) may be used in the package.

It must also be pointed out that the TYVEK® filtering material disclosed herein is just one exemplary type of filter material which may be utilized in the present invention. TYVEK® material, or similar materials (e.g., those identified hereinafter) appear to be particularly useful for packaging applications wherein the particulate material has some appreciable moisture content, since such materials do not degrade in the presence of moisture. If TYVEK® material is used, one particularly useful grade of TYVEK® material is grade 1422. However, other types of TYVEK material, or other types of material other than TYVEK® may be used. For example, a polyester material sold by Synergex under the number L103 may be used. In addition, Remay Co., of Old Hickory, Tenn. also sells a number of suitable filtering materials, such as a spun bonded polypropylene sold under the trademark TYPAR 3151. The Remay Co. also manufactures various types of polyester materials which are suitable for use in the present invention and are sold under product code numbers 2024,2011, 2014, and 2016. If the product to be held within the package is dry and has little or no moisture content, filter materials which may degrade in the presence of moisture, e.g., paper, may be used. In such applications the paper filter material forming the panels should preferably include some coating or other material applied to it to enable its peripheral edge to be sealed or otherwise adhered to the inner surface of the panel of the package to which the filter panel is to be secured.

Thus, as should be understood by those skilled in the art any type of sheet-like, relatively flexible, filtering material, be it woven, non-woven, solid with small pores or interstices, etc., may be used. Moreover, the porosity of the filter material used in the subject invention may be varied greatly depending upon a number of factors, e.g., particle size, package size, filter panel size, etc.

It must also be pointed out that while only a single valve is shown, and that valve is mounted on the upper portion of the front panel of the package, that arrangement is merely exemplary. Thus, the valve can be located anywhere on the package's panels. In fact, more that one valve can be used, with the location of the valve(s) being dependent upon the type of particulate material, the size, shape and construction of the package, etc.

Without further elaboration the foregoing will so fully illustrate our invention that others may, by applying current or future knowledge, adopt the same for use under various conditions of service.

We claim:

1. A package having an interior for holding a fine particulate material therein, said package having at least one wall panel, a degassing valve mounted on said wall panel, and a filter panel, said valve having an inner portion in communication with said interior of said packages an outer portion in communication with said exterior of said package and a movable element interposed between said inner portion and said outer portion and operative to enable gas within said package to vent to the ambient atmosphere outside said package, said package being formed of a flexible sheet material suitable for being hermetically sealed so that said fine particulate material is enclosed within said interior of said package, said filter panel being formed of a flat flexible sheet secured to at least one of said wall panels of said package over said interior portion of said valve to prevent said fine particulate material from entering said valve, said filter panel extending substantially beyond the periphery of the valve to provide a large surface area to facilitate the flow of gas out of the package through said valve.

2. The package of claim 1 wherein said filter panel comprises a spun bonded olefin, a spun bonded polyester or a spun bonded polypropylene.

3. The package of claim 1 wherein said filter panel covers only a portion of said one wall panel of said package.

4. The package of claim 3 wherein said portion of said one wall panel which said filter panel covers comprises a minor portion of said one wall panel.

5. The package of claim 3 wherein said portion of said one wall panel which said filter panel covers comprises a major portion of said one wall panel.

6. The package of claim 1 wherein said filter panel covers substantially all of the interior of said package.

7. The package of claim 1 wherein said package includes at least one gusset.

8. The package of claim 7 wherein said package comprises a front panel, a rear panel, and a pair of gussetted side panels, said valve being mounted on one of said front and rear panels, each of said front and rear panels and said side gussets having an upper edge and upper edge portions contiguous therewith, said upper edge portions being conjoined, said package including a mouth located adjacent said upper edge portions, said mouth being openable to provide access to the fine particulate material located within said interior of said package.

9. The package of claim 8 wherein said package includes means located adjacent said mouth of said package to enable said mouth to be peeled open.

10. The package of claim 1 wherein said package is in the form of a pouch, said pouch comprises a front panel, a rear panel, each of said panels having marginal edges, said marginal edges of said panels being connected together, said valve being mounted on one of said front and rear panels, each of said front and rear panels having an upper edge and upper edge portions contiguous therewith, said upper edge portions being conjoined, said package including a mouth located adjacent said upper edge portions, said mouth being openable to provide access to the fine particulate material located within said interior of said package.

* * * * *